US006274250B1

(12) United States Patent
Terziani

(10) Patent No.: US 6,274,250 B1
(45) Date of Patent: Aug. 14, 2001

(54) PROCESS FOR MANUFACTURE OF JEWELRY AND JEWELRY MADE THEREBY

(75) Inventor: Urbano Terziani, Civitella in val di Chiana (IT)

(73) Assignee: Cento Group S.p.A., Val Di Chiana (Arezzo) (IT)

( * ) Notice: Subject to any disclaimer, the term of this patent is extended or adjusted under 35 U.S.C. 154(b) by 0 days.

(21) Appl. No.: 09/605,655

(22) Filed: Jun. 28, 2000

Related U.S. Application Data

(62) Division of application No. 09/084,934, filed on May 28, 1998, now Pat. No. 6,146,772.

(30) Foreign Application Priority Data

Jul. 4, 1997 (IT) ..... FI97A0157

(51) Int. Cl.[7] ..... B32B 15/02; A44C 11/00

(52) U.S. Cl. ..... 428/579; 428/607; 428/598; 428/672; 63/4; 63/38

(58) Field of Search ..... 428/544, 577, 428/598, 582, 670, 579, 672, 673, 607, 614, 596; 63/4, 15, 15.7, 38, 35, 34; 29/896.4, 896.43; D11/13

(56) References Cited

U.S. PATENT DOCUMENTS

| | | | | |
|---|---|---|---|---|
| 394,603 | * | 12/1888 | Palmer | 428/607 |
| 450,412 | * | 4/1891 | Knight | 428/614 |
| 460,750 | * | 10/1891 | Knight | 428/614 |
| 921,722 | * | 5/1909 | Meyer . | |
| 1,382,607 | * | 6/1921 | Rathbone et al. | 428/614 |
| 1,996,183 | * | 4/1935 | Walters | 29/182 |
| 3,248,185 | * | 4/1966 | Barney | 428/614 |
| 3,973,716 | * | 8/1976 | Flamand | 228/118 |
| 4,716,750 | | 1/1988 | Tizzi | 72/52 |
| 5,525,423 | * | 6/1996 | Liberman et al. | 428/606 |

FOREIGN PATENT DOCUMENTS

| | | |
|---|---|---|
| 604599 | 9/1978 | (CH) . |
| 832734 | 2/1952 | (DE) . |
| 0638256 | 2/1995 | (EP) . |
| 1154682 | 1/1987 | (IT) . |
| 1-210115 * | 8/1989 | (JP) . |
| 1-253435 * | 10/1989 | (JP) . |

* cited by examiner

*Primary Examiner*—John J. Zimmerman
(74) *Attorney, Agent, or Firm*—Browdy & Neimark

(57) ABSTRACT

Ornamental jewelry is made from a composite wire for manufacturing semifinished products to be subjected to an emptying process. The wire comprises a support core (1) of a nonprecious metal that is removable by chemical or electrochemical means as well as a plurality of sections (3,4,5) of precious metal wherein at least a portion of each of said sections is radially engaged in the core.

6 Claims, 3 Drawing Sheets

PROCESS FOR MANUFACTURE OF JEWELRY AND JEWELRY MADE THEREBY

CROSS-REFERENCE TO RELATED APPLICATIONS

The present invention is a divisional of Ser. No. 09/084,934, filed May 28, 1998 now U.S. Pat. No. 6,146,772, the entire contents of which are hereby incorporated by reference.

FIELD OF THE INVENTION

The present invention relates to a method for producing semifinished jewelry products from a composite wire, and to a method for making finished articles of jewelry.

The present invention also relates to a process for producing composite wire as well as ornamental articles, in particularly of annular form, or chains made with said articles which can be manufactured from the composite wire by means of a mechanical process and an emptying process.

DESCRIPTION OF THE PRIOR ART

Techniques for producing "hollow" articles, i.e., articles composed of tubular elements in various conformations to form chain links, earrings, charms, and the like in precious metals are well known in the field of goldsmithery.

The most widely used technique used in manufacturing ornamental articles made of hollow wire, mainly for ornamental chains, is one in which there is used a composite wire formed from a support core of a nonprecious metal (iron, copper, or special alloys, such as tombak), on which a lamina of precious metal is folded. The lamina is firmly secured to the support core by engaging the longitudinal edges of the lamina in respective axial grooves formed on the surface of the support cores and subjecting this intermediate semifinished product to a mechanical drawing process in order to obtain the desired diameter. The composite wire obtained by this technique can be used in manual or mechanical processing, just as a solid wire is used, for example, to produce ornamental chains. The internal support cores is subsequently removed (called an emptying process) by subjecting the products to chemical or electrochemical treatment. This technique is described in Italian patent No. 1154682.

In the process described above, it is possible to obtain wire material of a conventional form allowing only for the possibility of changing the cross section. Furthermore, it is not possible with this technique to create a wire comprising more than one type of precious metal. There is a great demand in the field of gold craftsmanship for methods for producing new ornamental shapes and new techniques for making these shapes, which have a high level of flexibility of application and which offer opportunities for creative activity on the part of the designer.

SUMMARY OF THE INVENTION

It is an object of the present invention to provide a composite wire of a novel structure that can be used in the field of gold craftsmanship for manufacturing semifinished products to be subjected to an emptying process to produce articles of jewelry having an original configuration.

It is another object of the present invention to provide a composite wire of the above-mentioned type as well as a method for producing such wire which provides the designer with a vast range of possibilities to create articles of jewelry having an original configuration.

These and other objectives of the invention, which will become apparent in the description which follows, are accomplished with the composite wire according to the present invention whose novel feature is that is comprises an elongate support core made of a nonprecious metal that can be removed by chemical or electrochemical means as well as a plurality of elongate sections made of precious metal, of which at least a portion of which is radially engaged in the core.

In one currently preferred embodiment of the present invention, the sections are engaged in grooves having a depth equal to the width of the sections. Alternatively, the sections are incorporated in the core inside grooves which have a depth greater than the width of the sections and which close over them.

The sections can be flat, curvilinear, or C-shaped in form.

BRIEF DESCRIPTION OF THE DRAWINGS

Further characteristics and/or advantages of the composite wire according to the present invention will become apparent in the description which follows of some embodiments thereof, given as example but which are not limiting, with reference to the attached drawings in which.

DETAILED DESCRIPTION OF THE INVENTION

Figure 1:
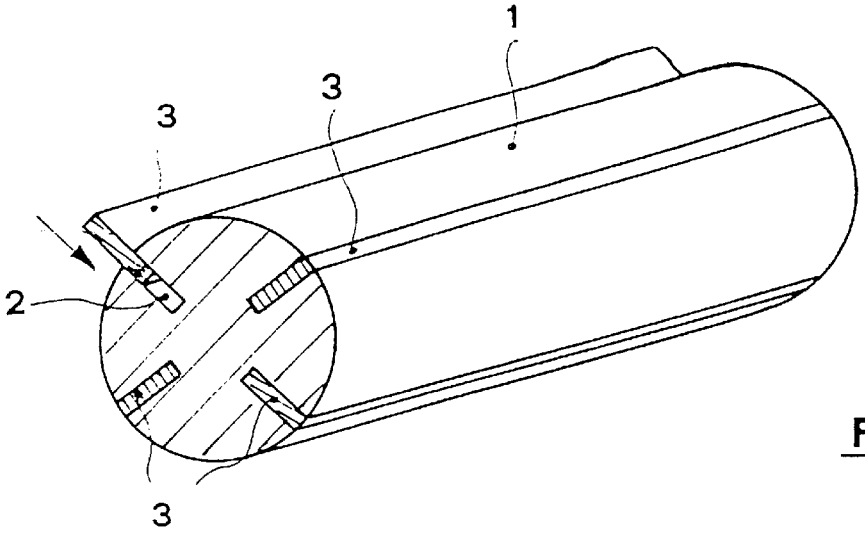
FIG. 1 is a perspective view of a length of support core with laminar sections engaged therein for the production of a composite wire according to a first embodiment of the invention.

FIG. 1 shows at 1, a length of a workpiece made of iron, copper, or an alloy, having an elongate form and a circular cross section. Four grooves 2 are formed on the side surface, each of which engages a flat laminar section 3 having a thickness and width equal, respectively, to the width and depth of the groove. The engagement of sections 3 in core 1 is stabilized and made permanent by means of drawing which, at the same time, reduces the dimensions of the assembly to those desired, transforming it into a wire which can be used as if it were a conventional solid wire to produce links, link chains, annular pieces of jewelry, and the like. Afterwards, the opposite ends of each annular element are soldered to each other in a conventional way, and the support core is finally removed by means of a conventional chemical or electrochemical treatment (emptying process).

Figure 2:
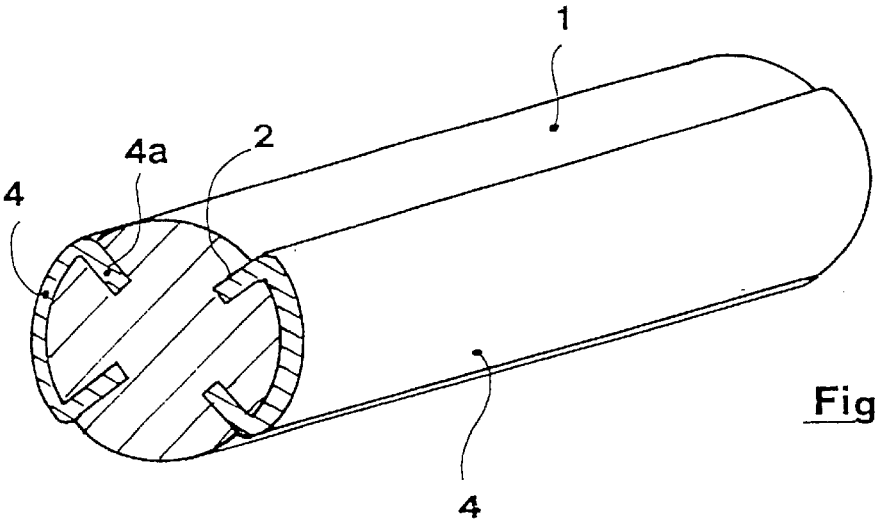
FIG. 2 is a perspective view of a length of support core with angular sections engaged therein for the production of a composite wire according to a second embodiment of the invention.

In the embodiment of the invention shown in FIG. 2, laminar sections 4 of precious metal extending along corresponding surface portions of core 1 are secured to support core 1. The laminar sections 4 are anchored by bending their edges 4*a* into angles that engage in adjacent pairs of grooves 2 formed axially on the side surface of core 1. Drawing stabilizes and makes permanent the engagement of edges 4*a* in support core 1, as in the previous case.

Figure 3:
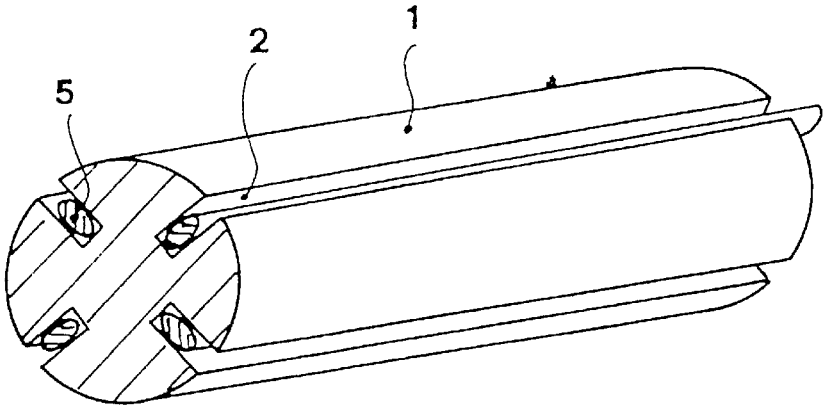
FIG. 3 is a perspective view of a length of support core with rounded sections engaged therein for the production of a composite wire according to a third embodiment of the invention.

In the embodiment of the invention shown in FIG. 3, the sections of precious metal engaged in grooves 2 of support core 1 are bars 5 with a curved cross section, particularly circular or elliptical, which have a height lower than the depth of the grooves 2. In this case, when subjecting the assembly formed by support core 1 and bars 5 engaged in grooves 2 to drawing, the bars remain incorporated in core 1 as the pressure acting on the core closes grooves 2 over bars 5.

Figure 8:
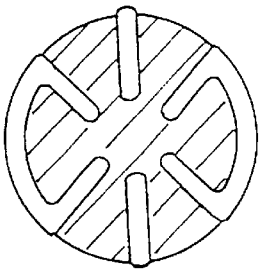
FIGS. 8, 9 and 10 show three examples of cross sections of composite wires according to the present invention which can be made by combination of different sections engaged with a support core.
Figure 9:
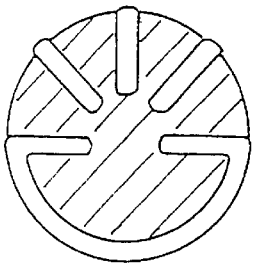
Figure 10:
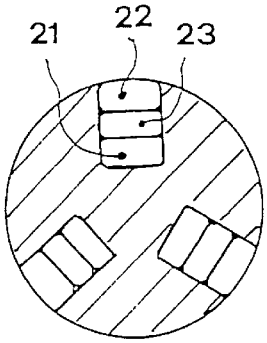

Of course, the cross section of the support core can be different from the circular one illustrated above, just as the shape, and cross section, and the number of precious metal sections engaged or incorporated in the core can be different. Furthermore, combinations of sections of different shapes and natures can be used. Non-limiting examples of such possible variations are illustrated in FIGS. 8, 9 and 10. In particular, the composite wire shown in FIG. 10 has more than one precious metal bar inserted in each groove, e.g., white gold 21 and yellow gold 22 with the interposition of a bar of removable metal 23 such as copper, so that, in the final product, the remaining precious metal elements are spaced apart.

Figure 4:
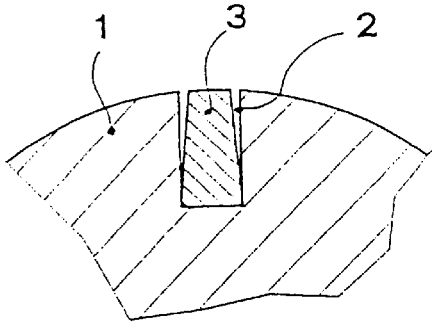
FIG. 4 is an enlarged partial cross sectional view of a possible variation of a composite wire according to the invention.

To increases the stability of the connection between the laminar precious metal sections an the support core, the cross section of the sections can advantageously have a trapezoidal shape, substantially as illustrated in FIG. 4, with the larger base of the cross section placed at the bottom of the respective groove. In this way, as a result of the drawing, the side faces of the groove close against the corresponding side faces of the section, thus creating a sort of dovetail connection which makes radial sliding impossible. Another solution for obtaining the same results consists of carrying out the grooves at an inclination with respect to the radial direction. Also, in this case, the deformation induced by the compressive forces acting during drawing on the shape of the groove and the cross section of the section eliminate the risk of radial sliding of the section.

Figure 5:
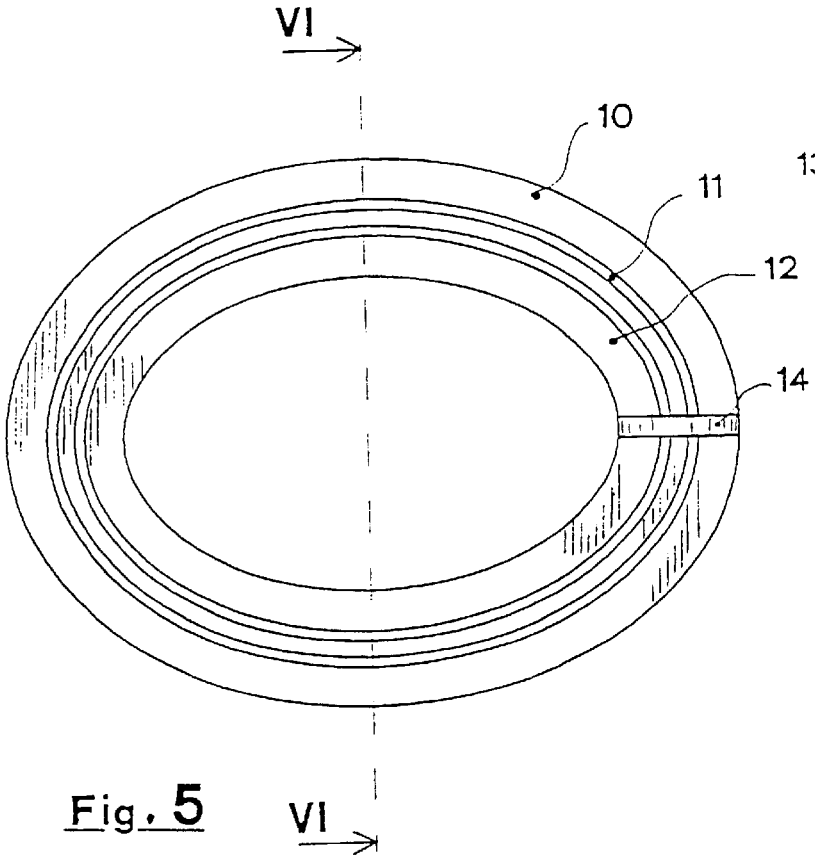
FIGS. 5 and 6 are a schematic view of an oval untwisted link in a plan view and a sectional view, respectively, made from the composite wire corresponding to that of FIG. 1 after it has been subjected to a drawing operation.
Figure 6:
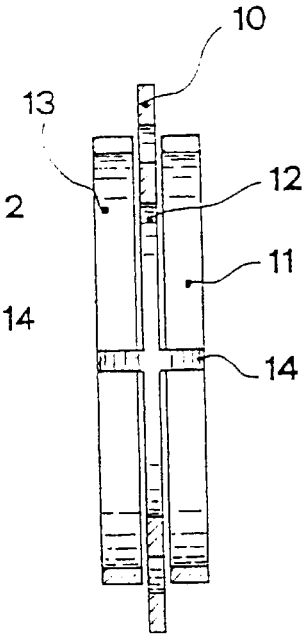

One practical example of the use of a composite wire according to the embodiment of FIG. 1 is illustrated in FIGS. 5 and 6 in which a flat oval link for ornamental chains obtained from the composite wire, following soldering and subsequent chemical emptying, is shown schematically. The link is composed for four annular flat laminar elements 10, 11, 12, and 13 extending radially from a common symmetrical circumferential axis in angularly spaced positions of 90°. The four laminar elements are fixed with their ends to the opposite faces of a transverse disc member 14 formed during soldering between the opposite ends of each link.

Obviously, in the majority of cases, the link is subjected to torsion both when it is made and when it is connected to other links, and therefore the radial laminar elements will assume a twisted appearance both with respect to the circumferential axis of symmetry as well as with respect to the median plane of the link. The analogous configurations of links that can be obtained with composite wires according to the embodiments of FIGS. 2 and 3 are not illustrated, since they are self-evident to one skilled in the art.

Figure 7:
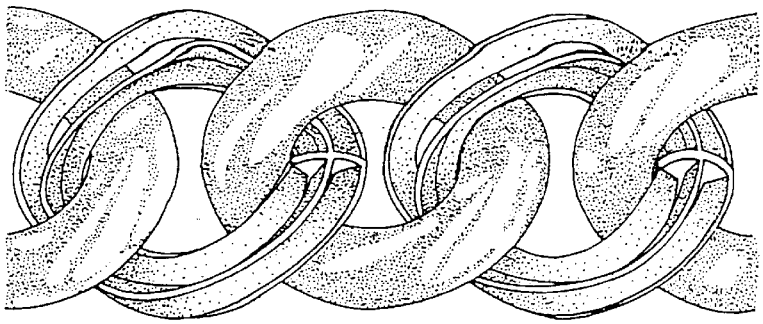
FIG. 7 shows an example of a length of ornamental chain including twisted links of the type shown in FIG. 5 and 6.

FIG. 7 shows a length of chain made of links such as illustrated in FIG. 5, but subjected to torsion, combined with conventional links having a continuous surface.

There are many advantages to the use of the composite wire according to the present invention in the field of crafting articles made of precious metal. The most significant of these are the following:

- the possibility of creating links for chains, or in any case annular pieces of jewelry, made of two or more different types of precious metal, or of different chromatic gradations of a single precious metal, such as yellow gold, white gold and pink gold;
- the possibility of obtaining a wide variety of links for chains, or in any case annular pieces of jewelry, by varying the number, form, arrangement and combination of sections in precious metal engaged both with a mainly radial development and a circumferential development;
- the possibility of inserting more than one side member 14 to create more discontinuities along the annular development of the piece of jewelry;
- the possibility of creating links, or in any case annular pieces of jewelry, having mixed shape or, in other words formed by half a link of continuous surface and half a link of radial or circumferential sections obtained by diametrically cutting one link having a conventional continuous surface and another link, such as the one shown in FIG. 5, of equal dimensions, and subsequently soldering the two halves together;
- the possibility of creating links, on in any case annular pieces of jewelry, having a spiral or multiple helical appearance by correspondingly twisting the composite wire before its processing, for example, in a chain making machine.

Although the most frequent foreseeable application for the composite wire according to the present invention is in the field of the manufacture of ornamental chains, it is clear that this process can also be used to produce bracelets, earrings, and pendants in general, as well as central and intermediate elements of necklaces, chokers, bracelets, and the like.

Variations and/or modifications can be brought to the composite wire for the field of gold craftsmanship according to the present invention without departing from the scope of the invention as set forth in the appended claims.

What is claimed is:

1. An ornamental piece of jewelry having a substantially annular form made from a composite wire, said composite wire comprising an elongate support core made of a non-precious metal that, in said ornamental piece of jewelry, has been removed by chemical electrochemical action; and a plurality of elongate sections of precious metal, of which at least one portion of each is, prior to the removal of the support core, radially engaged in said core;

said ornamental piece of jewelry comprising a plurality of substantially laminar or wire elements extending along an axis of circumferential symmetry and at least one disc member, to opposite faces of which the ends of said plurality of laminar or wire elements are connected.

2. The ornamental piece of jewelry according to claim 1 wherein said laminar or wire elements have a substantially curvilinear cross section.

3. The ornamental piece of jewelry according to claim 1 wherein said laminar or wire elements have a substantially flat cross section.

4. The ornamental piece of jewelry according to claim 1 wherein said laminar or wire elements form a helix around a common circumferential axis.

5. The ornamental piece of jewelry according to claim 1 wherein said circumferential axis is twisted with respect to a median plane.

6. A piece of jewelry selected from the group consisting of an ornamental chain, a ring, a bracelet, a necklace, an earring and a pendant, wherein said piece of jewelry comprises as a part thereof the ornamental piece of jewelry of claim 1.

* * * * *